United States Patent [19]

Bedell et al.

[11] Patent Number: 4,649,984

[45] Date of Patent: Mar. 17, 1987

[54] METHOD OF AND APPARATUS FOR CASTING METAL STRIP EMPLOYING A LOCALIZED CONDITIONING SHOE

[75] Inventors: John R. Bedell, Madison; Naim S. Hemmat, Mendham; Paul Jeges, Blairstown, all of N.J.

[73] Assignee: Allied Corporation, Morris Township, Morris County, N.J.

[21] Appl. No.: 876,652

[22] Filed: Jun. 17, 1986

Related U.S. Application Data

[63] Continuation of Ser. No. 633,551, Jul. 23, 1984, abandoned.

[51] Int. Cl.[4] ..... B22D 11/06; B22D 11/10

[52] U.S. Cl. ..... 164/463; 164/254; 164/415; 164/429; 164/437; 164/474; 164/475; 164/479; 164/488; 222/603

[58] Field of Search ..... 164/463, 474, 479, 488, 164/254, 423, 429, 437, 475, 415, 438; 222/590, 591, 594, 603

[56] References Cited

U.S. PATENT DOCUMENTS

| | | | |
|---|---|---|---|
| 3,861,450 | 1/1975 | Mobley et al. | 164/479 X |
| 3,862,658 | 1/1975 | Bedell | 164/423 X |
| 3,896,870 | 7/1975 | Massoubre | 164/423 |
| 4,142,571 | 3/1979 | Narashimhan | 164/429 X |
| 4,144,926 | 3/1979 | Liebermann | 164/463 |
| 4,150,706 | 4/1979 | Reiniche et al. | 164/423 X |
| 4,154,283 | 5/1979 | Ray et al. | 164/423 X |
| 4,177,856 | 12/1979 | Liebermann | 164/423 X |
| 4,202,404 | 5/1980 | Carlson | 164/423 |
| 4,262,734 | 4/1981 | Liebermann | 164/427 X |
| 4,282,921 | 8/1981 | Liebermann | 164/475 X |
| 4,290,476 | 9/1981 | Smith et al. | 164/423 |
| 4,301,855 | 11/1981 | Suzuki et al. | 164/423 X |
| 4,433,715 | 2/1984 | Smith | 164/437 X |
| 4,566,525 | 1/1986 | Li et al. | 164/463 |

FOREIGN PATENT DOCUMENTS

| | | | |
|---|---|---|---|
| 57-14446 | 1/1982 | Japan | 164/463 |
| 57-44455 | 3/1982 | Japan | 164/423 |
| 57-137058 | 8/1982 | Japan | 164/463 |
| 58-29554 | 2/1983 | Japan | 164/463 |
| 622725 | 4/1981 | Switzerland | 164/463 |
| 2112913A | 7/1983 | United Kingdom | 164/475 |

*Primary Examiner*—Nicholas P. Godici
*Assistant Examiner*—J. Reed Batten, Jr.
*Attorney, Agent, or Firm*—James Riesenfeld; Paul Yee

[57] ABSTRACT

An apparatus for casting metal strip includes a nozzle having an orifice for depositing a stream of molten metal onto a casting region of a moving chill surface. A conditioning shoe is located generally upstream from the nozzle in a direction opposite to the direction of chill surface movement to delimit a conditioning chamber. The conditioning chamber communicates directly with the nozzle orifice and borders at least three sidelines of the chill surface casting portion. A shield for minimizing an intrusion of ambient atmosphere into the conditioning chamber and for deflecting an entrained gas boundary layer carried along by the chill surface is cooperatively connected to the conditioning shoe. Gas control provides a selected, low density atmosphere, such as a partial vacuum, within the conditioning chamber.

8 Claims, 11 Drawing Figures

BEST AVAILABLE COPY

METHOD OF AND APPARATUS FOR CASTING METAL STRIP EMPLOYING A LOCALIZED CONDITIONING SHOE

This application is a continuation of application Ser. No. 633,551 filed July 23, 1984 and now abandoned.

BACKGROUND OF THE INVENTION

1. Field of the Invention

The invention relates to the casting of metal strip. More particularly, it relates to a localized conditioning chamber employed to cast rapidly solidified alloys.

2. Description of the Prior Art

U.S. Pat. No. 4,142,571 issued to M. Narasimhan discloses a conventional apparatus and method for rapidly quenching a stream of molten metal to form continuous metal strip. The metal can be cast in an inert atmosphere or a partial vacuum. U.S. Pat. No. 3,862,658 issued to J. Bedell and U.S. Pat. No. 4,202,404 issued to C. Carlson disclose flexible belts employed to prolong contact of cast metal filament with a quench surface.

The casting of very smooth strip has been difficult with conventional devices because gas pockets entrapped between the quench surface and the molten metal during quenching form gas pocket defects. These defects, along with other factors, cause considerable roughness on the quench surface side as well as the opposite, free surface side of the cast strip. In some cases, the surface defects actually perforate the strip.

U.S. Pat. No. 4,154,283 to R. Ray et al. discloses that vacuum casting of metal strip reduces the formation of gas pocket defects. The vacuum casting system taught by Ray et al. requires specialized chambers and pumps to produce a low pressure casting atmosphere. In addition, auxiliary means are required to continuously transport the cast strip out of the vacuum chamber. Further, in such a vacuum casting system, the strip tends to weld excessively to the quench surface instead of breaking away as typically happens when casting in an ambient atmosphere.

U.S. Pat. No. 4,301,855 issued to H. Suzuki et al. discloses an apparatus for casting metal ribbon wherein the molten metal is poured from a heated nozzle onto the outer peripheral surface of a rotary roll. A cover encloses the roll surface upstream of the nozzle to provide a chamber, the atmosphere of which is evacuated by a vacuum pump. The apparatus disclosed by Suzuki et al. does not pour metal onto the casting surface until that surface has exited the vacuum chamber; the ribbon is actually cast in the open atmosphere.

U.S. Pat. No. 3,861,450 to Mobley, et al. discloses a method and apparatus for making metal filament. A disk-like, heat-extracting member rotates to dip an edge surface thereof into a molten pool, and a non-oxidizing gas is introduced at a critical process region where the moving surface enters the melt. In a particular embodiment, a cover composed of carbon or graphite encloses a portion of the disk and reacts with the oxygen adjacent the cover to produce non-oxidizing carbon monoxide and carbon dioxide gases which can then surround the disk portion and the entry region of the melt.

U.S. Pat. No. 4,282,921 and U.S. Pat. No. 4,262,734 issued to H. Liebermann disclose an apparatus and method in which coaxial gas jets are employed to reduce edge defects in rapidly quenched amorphous strips. U.S. Pat. No. 4,177,856 and U.S. Pat. No. 4,144,926 issued to H. Liebermann disclose a method and apparatus in which a Reynolds number parameter is controlled to reduce edge defects in rapidly quenched amorphous strip. Gas densities and Reynolds numbers, are regulated by the use of vacuum and by employing lower molecular weight gases.

Conventional methods, however, have been unable to adequately reduce surface defects in cast metal strip caused by the entrapment of gas pockets. Vacuum casting procedures have afforded some success, but when using vacuum casting, the difficulty of removing the cast strip from the vacuum chamber has resulted in lower yields and increased production costs. As a result, conventional methods have been unable to provide a commercially acceptable process that efficiently produces smooth strip with consistent quality and consistent, uniform cross-section.

SUMMARY OF THE INVENTION

The present invention provides an apparatus for casting metal strip. Generally stated, the apparatus includes a nozzle means which has an orifice for depositing a stream of molten metal onto a casting region of a moving chill surface. A conditioning shoe is located at the casting region and delimits a conditioning chamber. The chamber borders at least three sidelines of the chill surface casting portion and is in direct fluid communication with the nozzle orifice. Shielding means connected to the conditioning shoe minimize an intrusion of ambient atmosphere into the conditioning chamber and deflect an entrained boundary layer carried along by the chill surface. Gas control means provide a selected, low density atmosphere within the conditioning chamber.

The method and apparatus of the invention advantageously avoid the need for large and cumbersome vacuum chambers, and can be readily practiced in an ambient commercial setting. The localized, low density atmosphere provided by the invention improves the heat transfer during the quenching operation, and improves the surface finish of the cast strip. In particular, casting in a low density atmosphere minimizes air pocket type defects that can be formed when air is trapped between the quench surface and the molten metal.

The trapped air can act as an insulator which reduces heat transfer from the molten metal and decreases the quench rate. Minimizing the air pockets provides a more uniform quenching of the metal and improves the physical properties of the cast strip. In particular, the reduction of surface defects on the quenched surface side of the strip increases the packing factor of the material and decreases localized stress concentrations that can cause premature mechanical failure.

In addition, the method and apparatus of the invention reduce the chilling effects on the nozzle caused by the movement of the airstream and boundary layer past the nozzle, and can reduce freezing and clogging of molten metal within the casting orifice.

Thus, the present invention effectively minimizes gas pocket defects on the strip surface which contacts the quench surface, and produces strip having a smooth surface finish and uniform physical properties. Complex equipment and procedures associated with large vacuum casting chambers are avoided.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF PREFERRED EMBODIMENTS

For the purposes of the present invention and as used in the specification and claims, a strip is a slender body, the transverse dimensions of which are smaller than its length. Thus, a strip includes wire, ribbon, sheet and the like of regular or irregular cross-section.

The present invention is suitable for casting metal strip composed of crystalline or amorphous metal and is particularly suited for producing metal strip which is rapidly solidified and quenched at a rate of at least about $10^4$ °C./sec from a melt of molten metal. Such rapidly solidified strip has improved physical properties, such as improved tensile strength, ductility and magnetic properties. A suitable method and apparatus for casting rapidly quenched metal strip are described in U.S. Pat. No. 4,142,571 to Narasimhan, which is hereby incorporated by reference thereto.

Figure 1:
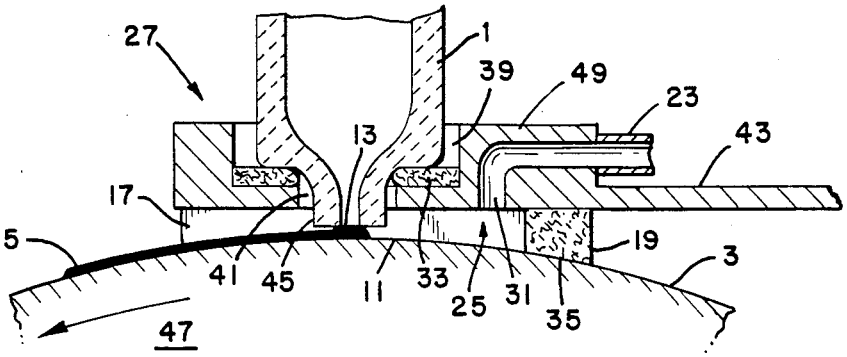
FIG. 1 shows a cross-sectional side plan view of a representative apparatus of the invention.
Figure 2:
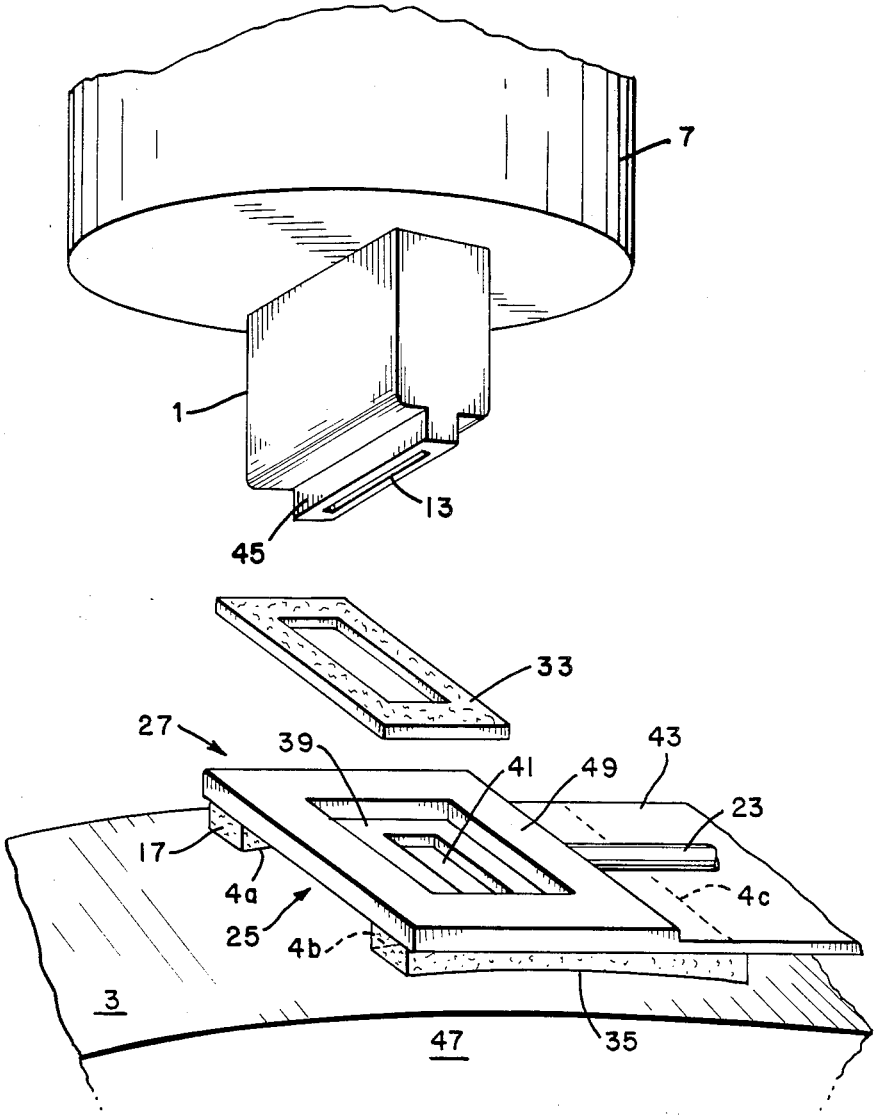
FIG. 2 shows a top perspective view of a representative apparatus of the invention.

FIGS. 1 and 2 illustrate a representative apparatus of the invention configured to cast rapidly solidified metal strip, such as amorphous, glassy metal strip 5. Nozzle means 1 is constructed of a refractory material such as zirconia, and has an orifice 13 for depositing a stream of molten metal onto casting region 11 of moving chill surface 3. Chill surface 3 is, for example, provided by a moving casting belt or a rotating chill roll 47. Conditioning shoe 27 is located generally upstream from nozzle 1 in a direction opposite to the direction of chill surface movement, and delimits a conditioning chamber. Conditioning chamber 25 communicates directly with orifice 13 and has casting portion 11 of the chill surface located therein. Shielding means, such as sliding seals 17, 19 and top gasket 33, cooperatively connect to top plate 43 of shoe 27. Front, upstream seal 19 deflects the entrained gaseous boundary layer carried along by the rapidly moving chill surface 3, while side seals 17 and gasket 33 minimize the intrusion of ambient atmosphere into conditioning chamber 25. A gas control means, comprised of conduit 23 and a suitable gas supply means, communicates with chamber 25 through opening 31 and provides a low density atmosphere within the conditioning chamber. The low density atmosphere is one having a pressure of not more than about 26 in. Hg (88 kPa).

Chill surface casting portion 11 includes the portion of chill surface 3 upon which molten metal deposits and initially contacts the chill surface for quenching. Casting portion 11 also includes a portion of chill surface 3 which extends a selected distance immediately upstream from the deposited molten metal, measured in a direction opposite to the direction of chill surface movement.

Conditioning shoe 27 is comprised of a top plate 43, which includes an upward extending ridge portion 49. Ridge portion 49 defines a cavity 39 configured to accept placement of nozzle 1 therein. Nozzle 1 includes an extended lip portion 45 which extends through top plate opening 41 into conditioning chamber 25 to establish a selected gap separation distance between chill surface 3 and the nozzle orifice 13. A high temperature shielding gasket 33 composed of a flexible and compressible material, such as ceramic felt is interposed between nozzle 1 and the bottom of top plate cavity 39 to minimize the intrusion of ambient atmosphere through opening 41. A front wall is connected to top plate 43, and is comprised of front shield member 19. Two side walls connect to the front wall and to the top plate, and are comprised of side shield members 17. Shields 17 and 19 are composed of a high temperature resistant material, which is resistant to wear and has a low coefficient of friction and, are slightly compressible. Suitable materials include, for example, graphite, a ceramic felt, such as FIBER FRAX, manufactured by Carborundum Company, or ceramic felt impregnated with graphite. A particularly effective shield is composed of ceramic felt impregnated with a colloidal graphite, such as GRAPHOKOTE-220 manufactured by Joseph Dixon Crucible Co., Jersey City, N.J. This impregnated shield material does not excessively mar or contaminate the chill surface, and does not excessively wear during operation.

Front shield 19 and side shields 17 extend from top plate 43 and are adapted to slidably contact chill surface 3 along surfaces 35. Preferably, the sidewalls and shields 17 are substantially parallel to each other and extend downstream from the front wall to a location at or past the position of orifice 13. Additionally, the two sidewalls and associated shields are spaced apart from each other by a distance approximately equal to the width of the cast strip to provide improved shielding effectiveness. Side seals 17 minimize the side ways intrusion of ambient atmosphere.

When placed in sliding contact against chill surface 3 and abutted against nozzle 1, conditioning shoe 27 delimits a conditioning chamber 25 which extends around the casting portion 11 of the chill surface. The conditioning shoe borders at least three sidelines 4*a*, 4*b* and 4*c* of the chill surface casting portion and effectively encloses the casting portion.

Figure 3B:
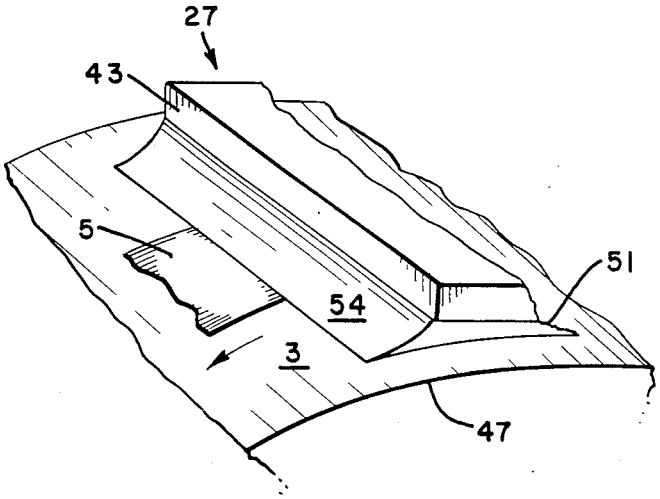
FIG. 3*b* shows a representative conditioning shoe which includes a downstream, shielding flap member.
Figure 3A:
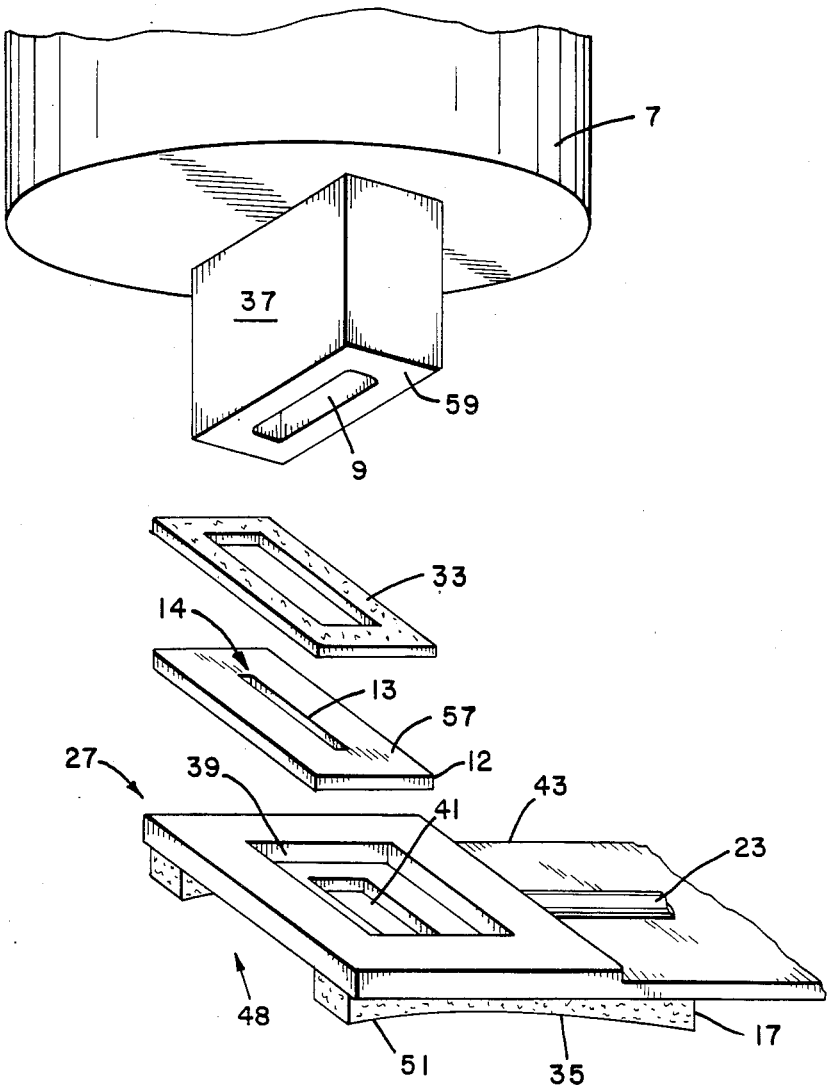
FIG. 3*a* shows an exploded perspective view of a representative apparatus of the invention having a replaceable nozzle member.

During operation, the cast strip exits through back opening 48 of chamber 25, as representatively shown in FIG. 3*a*. As shown in FIG. 2, top shielding gasket 33, which abuts the bottom of cavity 39 and nozzle 1, minimizes the intrusion of ambient atmosphere into the top of conditioning shoe 27.

FIG. 3*b* representatively shows a conditioning shoe 27 which includes a modified downstream exit portion. A resilient, moveable flap member 54, composed of a suitable flexible metal or elastomeric material, connects to the exit portion of conditioning shoe 27, and the downstream portion 51 of the side shields are contoured to substantially match the contour of the flap. Flap 54 is moveable upwards to allow passage of strip 5 thereunder, but its flexible resilience also minimizes the size of the downstream opening into chamber 25 by slidably contacting chill surface 3 or strip 5. As a result, flap 54 minimizes the intrusion of ambient atmosphere into the downstream, fourth side of conditioning chamber 25 and better maintains any partial vacuum induced in the chamber.

It is readily apparent that casting region 11 continuously changes as chill surface 3 moves due to the rotation of chill roll 47. As chill surface 3 moves at the high speeds required to cast amorphous metals or rapidly solidified crystalline metals, the chill surface carries along with it an adherent gaseous boundary layer. The momentum of the moving gas boundary layer can seriously disrupt the casting process. In an extreme case, the moving gas can disintegrate the stream of molten metal coming from orifice 13 and prevent the formation of continuous strip. In less severe situations, the moving gas boundary layer can cause localized lift-off areas on the chill surface side of the cast ribbon and can also cause "chatter".

Lift-off areas are manifested by their pocket type depressions on the cast ribbon surfaces. These depressions are undesirable because they degrade surface quality and inhibit the desired uniform quench rate throughout the ribbon. Lift-off areas are thermally insulated from chill surface 3 and, therefore, are less rapidly quenched than the regions in actual contact with the chill surface.

Chatter is manifested by irregular, transverse striations or "chatter marks" on the free side of the cast strip and by clusters of voids on the chill surface side of the cast strip. These defects degrade surface quality.

Conditioning shoe 27 advantageously deflects the high velocity gas boundary layer from casting portion 11. In particular, front shield 19 effectively scrapes the boundary layer from moving chill surface 3, and side shields 17 minimize the reintroduction of moving gas from the ambient atmosphere into the region behind front shield 19. To accomplish this, front shield 19 and side shields 17 are closely fitted against plate 43 and chill surface 3, and gasket 33 is constructed and arranged to operatively seal the top of the shoe. Chatter marks and entrapped gas pockets can be significantly reduced by introducing a nonreactive, low density gas at a flow rate ranging from about 0.1 to about 1.0 cubic feet per minute into chamber 25 by way of conduit 23 from a suitable gas supply. A suitable gas would be helium.

To minimize the occurrence of gas pockets on the chill surface side of strip 5 more effectively, a suitable vacuum pump is operably connected to conduit 23 to reduce the gas pressure in conditioning chamber 25 to a level of about 630 mm Hg (84 KPa) or less. This partial vacuum provides a low density atmosphere.

A suitable transport means connects to conditioning shoe 27 to selectively move the shoe into position around chill surface casting portion 11. For example, a mechanical arm can connect to conduit 23 to selectively move the conditioning shoe into the operable position against nozzle 1 and casting surface 3. The capability of selectively removing conditioning shoe 27 away from nozzle 1 and chill surface 3 enhances the ease of inspecting and maintaining the nozzle and chill surface.

FIG. 3*a* shows an exploded, perspective view of a representative apparatus of the invention which includes a replaceable nozzle member 12. During the casting of metal strip, orifice 13 can erode into an irregular shape, can crack or can become clogged with foreign matter. In each case, it is desirable to replace the orifice portion of the casting nozzle means as quickly as possible with a minimum of disruption of the casting apparatus.

Figure 4:
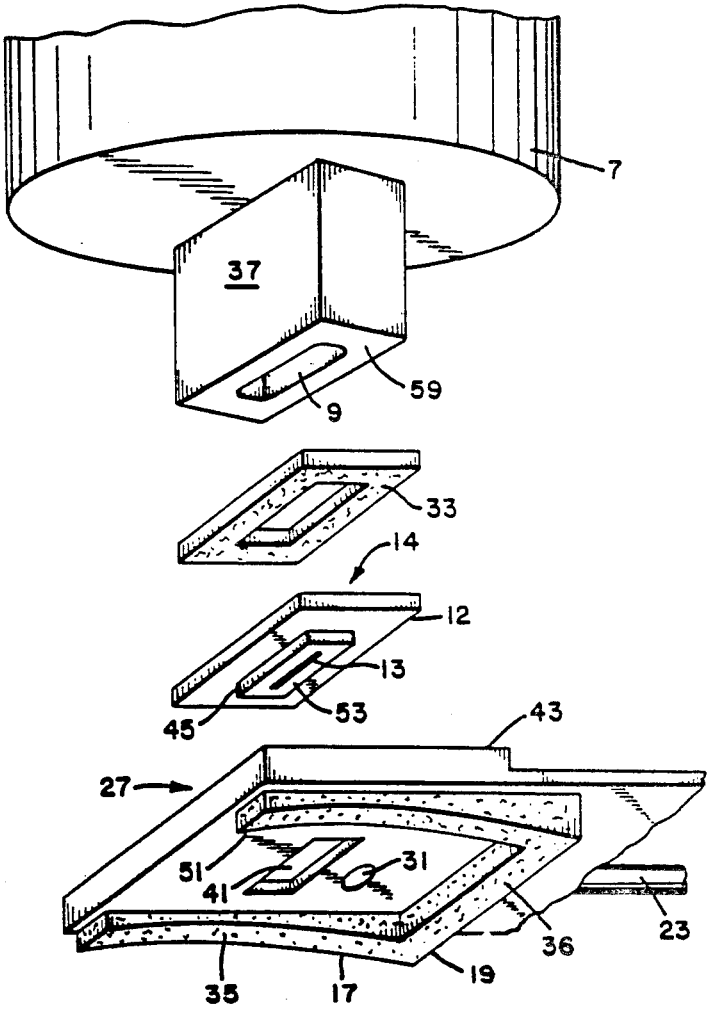
FIG. 4 shows an exploded bottom perspective view of a representative apparatus of the invention having a replaceable nozzle member.
Figure 5:
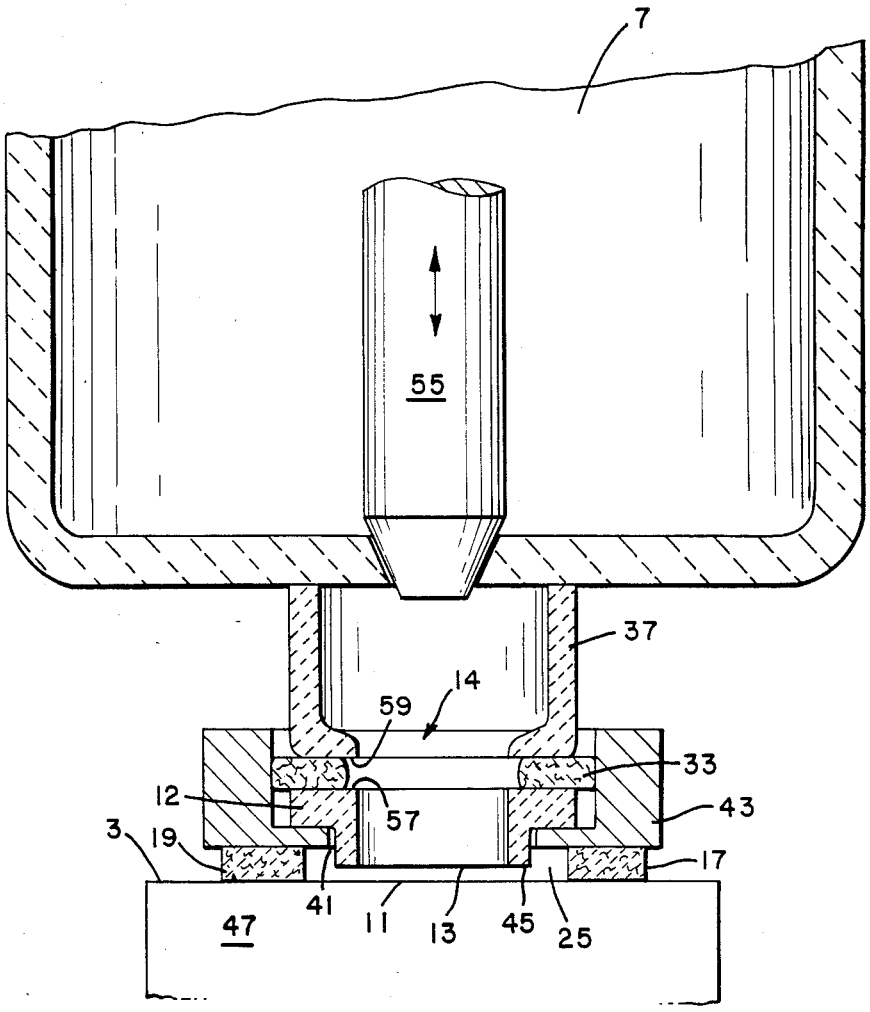
FIG. 5 shows a cross-sectional view of apparatus shown in FIG. 4 viewed in the upstream direction.

The embodiment of the invention representatively shown in FIGS. 3*a*, 4 and 5 employs a replaceable nozzle member 12, which is constructed to selectively connect to reservoir means 7. Reservoir 7 holds molten metal and has an extended portion adapted to mate with nozzle member 12. Nozzle member 12 is configured as a generally flat plate member having an inlet portion, shown generally at 14, and an exit orifice 13. In addition, a portion 45 of nozzle member 12 is configured to extend through opening 41 in support plate 43. Nozzle member mounting surface 57, which is located about inlet 14, is substantially planar, and is configured to selectively mate with a corresponding, substantially flat mounting surface 59 on the outlet end of reservoir extension 37. A reservoi outlet portion 9 extends through the bottom of reservoir 7 and is in fluid communication with the casting orifice 13 formed through nozzle member 12. A flexible, high temperature resistant gasket material, such as FIBER FRAX, is interposed between the mating surfaces of extension 37 and nozzle member 12 to minimize leakage of molten metal.

The nozzle configuration illustrated in FIGS. 4 and 5 is particularly resistant to cracking because there can be a lateral side-to-side, sliding-type motion along the substantially parallel surfaces 57 and 59. This movement compensates for any difference in thermal expansions between nozzle 12 and extension 37. As a result, cracking and leakage at the region, where the vertical section (extension 37) joins the horizontal section (nozzle 12), can be minimized. In addition, nozzle member 12 can be constructed from a material different than the material employed to construct extension 37. As a result, the material of member 12 can be selected to provide optimized physical properties, such as improved strength, and high erosion resistance. Where the desired nozzle member material is particularly expensive, the illustrated apparatus configuration can help minimize costs.

Conditioning shoe 27 includes a support means, such as support plate 43, which holds nozzle member 12 assembled to reservoir 7. In the embodiment shown in FIG. 3*a*, support plate 43 has a cavity 39 formed into the top surface of the plate and suitably configured to accommodate placement of nozzle member 12 therein. Cavity 39 helps to locate the nozzle member on the support plate in a predetermined position. Support plate 43 also has an opening 41 configured to accommodate a placement of nozzle lip extension 45 therethrough. Nozzle extension 45 allows proper placement of nozzle orifice 13 and nozzle lip surfaces 53 at the appropriate separation gap from chill surface 3.

As representatively shown in FIG. 4, side shields 17 and front shield 19 connect to the bottom of support plate 43 and are adapted to slidably contact chill surface 3 along the sliding surfaces 35 and 36. Passageway 31 provides fluid communication between conditioning chamber 25 and conduit 23 (see FIG. 1). Support plate 43 connects to a suitable force mechanism which selectively moves the support plate into a position which holds nozzle member 12 connected to reservoir 7 and provides a conditioning chamber 25 around the casting region 11 of chill surface 3. For example, the force mechanism can be an actuator arm connected to conduit 23 or conduit 23 itself.

To remove and replace nozzle member 12, a stopper rod 55 is positioned to stop the flow of molten metal through orifice 13, and the assembly comprised of reservoir 7, nozzle member 12 and conditioning shoe 27 is moved a selected distance away from chill surface 3 to allow sufficient working space. Support plate 43 is then moved away from reservoir 7 and nozzle member 12 is disconnected from the reservoir. A new, replacement nozzle assembly and gasket 33 are then installed in the receiving cavity 39 of support plate 43, and support plate 43 is moved to reassemble nozzle member 12 to reservoir 7. The new assembly of nozzle member 12, reservoir 7 and conditioning shoe 27 is then relocated in position around chill surface casting portion 11 to again delimit conditioning chamber 25. Stopper rod 55 is then removed to re-establish the flow of molten metal.

It is readily apparent that the quick replacement aspect of the invention can be utilized without forming a conditioning chamber at the chill surface. In such a configuration, support plate 43 is constructed without shields 17 and 19, and a suitable transport carrier connects to conduit 23 to selectively position plate 43 and hold nozzle 12 assembled to reservoir extension 37.

In a further modification of the invention, a plurality of nozzle members 12 and associated support plates 43 are carried by an indexing transport means, such as a rotating turret mechanism. The turret has a plurality of radially extending arms, each carrying a support plate and a nozzle member. As an old, worn-out nozzle member is removed from the casting apparatus, a new nozzle member is moved into position for mating against reservior extension 37 by the rotation of the turret.

Additionally, the configuration of the invention illustrated in FIGS. 4 and 5 can advantageously provide an effective means for minimizing variations in the gap between exit orifice 13 and casting surface 3. To accomplish this, sliding seals 17 and 19 are constructed of material that has relatively low compressibility compared to top shielding gasket 33. For example, seals 17 and 19 can be constructed from graphite or from a steel surface with a layer of low friction material. Such seals would have a very small compressibility limit of about 0.0005 in. (0.00127 cm) or less. Gasket 33, in comparison, is constructed from a material, such as a ceramic felt, that has sufficient thickness and compressibility to provide an exemplary increment of compression of about 0.005 in. (0.0127 cm). This compression allows relative movement between the nozzle member 12 and reservoir extension 37.

The dimensions of the component parts of the apparatus, such as thickness of seals 17 and 19, and gasket 33, are adjusted to provide a preselected gap between exit orifice and casting surface 3 when nozzle member 12 is assembled to support plate 43 and urged to slightly compress gasket 33 against reservoir extension 37. Thusly configured, small expansions and compressions of gasket 33 compensate for eccentricities in casting surface 3 and compensate for small drifts of the reservoir from its original position over the casting surface. Gasket 33 can compress or expand as casting surface rises or falls with respect to reservoir 7 while still providing an effective seal. Since the other components, such as seals 17 and 19 and plate 43, are substantially incompressible and do not significantly change their dimensions, the gap between orifice 13 and chill surface 3 remains substantially unchanged during the operation of the casting apparatus. The mass of the conditioning shoe 27 and nozzle member 12 assembly should be as small as practicable to enable it to readily and accurately follow small displacements of the reservoir or casting surface.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE 1

The apparatus of the invention shown in FIGS. 1 and 2 was employed to cast metal strip composed of about 92 wt % Fe -3 wt % B -5 wt % Si.

Figure 6A:
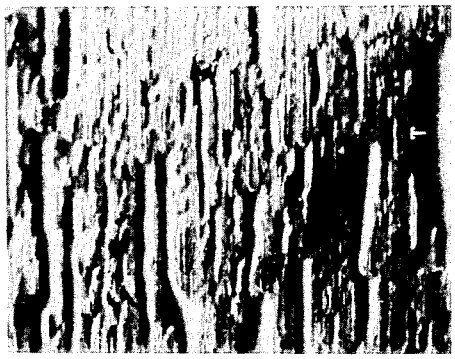
FIG. 6*a* and 6*b* show a representative strip cast in the ambient atmosphere.
Figure 6B:
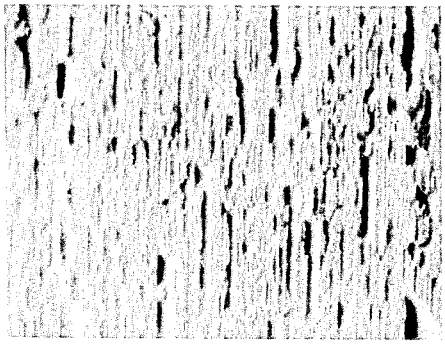

In a first run, conditioning shoe 27 was removed and the metal strip cast in the ambient atmosphere. The underside of the cast strip is shown in FIGS. 6*a* and 6*b*. FIG. 6*a* shows the topography of the cast ribbon underside at the locations of chatter marks. FIG. 6*b* shows the topography of the cast ribbon underside at locations between chatter marks.

EXAMPLE 2

The apparatus of the invention was employed to cast metal strip with conditioning shoe 27 installed in position. During separate runs, helium was supplied into conditioning chamber 25 at the different flow rates of 0.1, 0.2, 0.4, 0.7 and 1.0 $ft^3$/min. The flow of helium effectively eliminated chatter marks when introduced into chamber 25 at flow rates greater than about 0.1 $ft^3$/min.

EXAMPLE 3

Figure 7A:
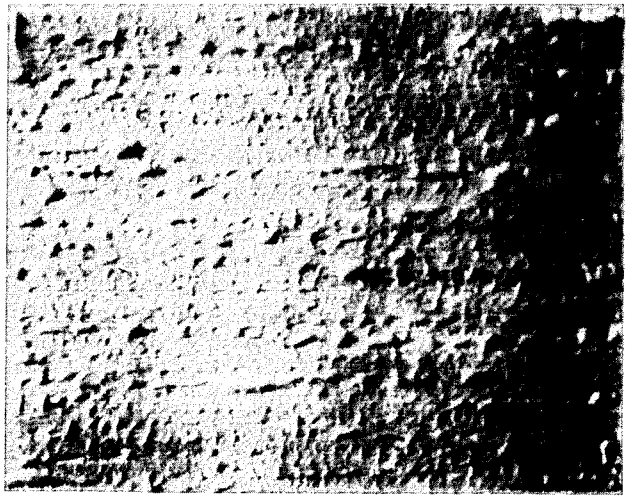
FIGS. 7*a*, 7*b* and 7*c* show representative strips cast with the apparatus of the invention with different partial vacuums in the conditioning shoe.
Figure 7B:
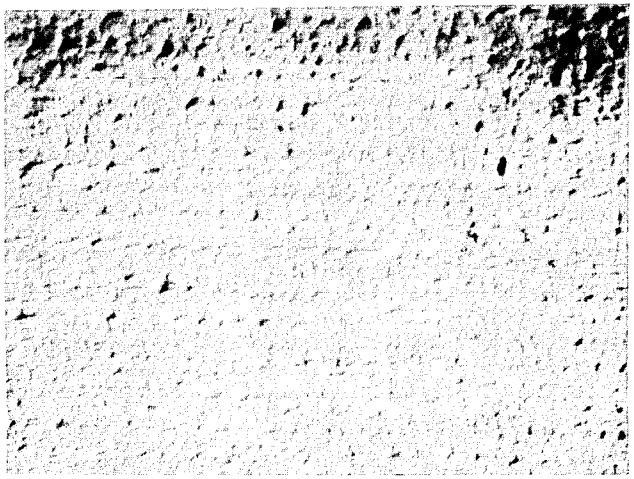
Figure 7C:
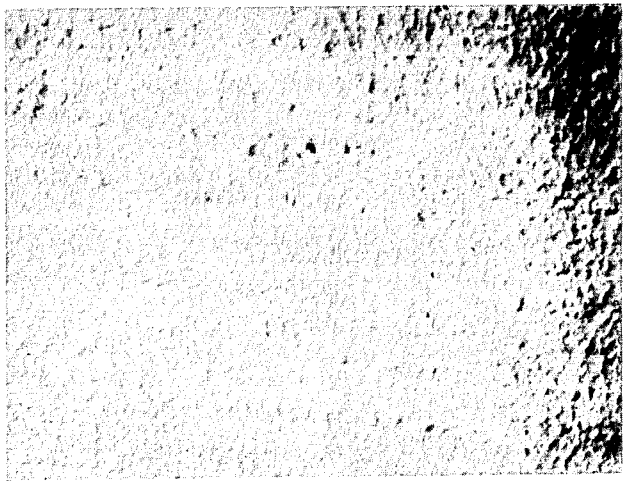

The apparatus of the invention was employed to cast metal strip with conditioning shoe 27 installed in operable position on the chill wheel. A vacuum pump connected to conduit 23 on separate casts provided partial vacuums (about 5 and 10 in. Hg below ambient pressure) within conditioning chamber 25 during the casting process. As shown in FIGS. 7*a*, 7*b* and 7*c*, the chill surface side of the partial vacuum cast strip had significantly smaller air pocket defects than the strip cast in the open air.

Having thus described the invention in rather full detail, it will be understood that such detail need not be strictly adhered to but that various changes and modifications may suggest themselves to one skilled in the art, all falling within the scope of the invention as defined by the subjoined claims.

We claim:

1. A method for casting metal strip, comprising the steps of:

a. depositing a stream of molten metal onto a casting portion of a moving chill surface;

b. delimiting a localized conditioning chamber which borders at least three sidelines of said chill surface casting portion;

c. shielding a front portion of said conditioning chamber with a front shielding means which slidably contacts said chill surface and deflects an entrained boundary layer carried along by said chill surface;

d. shielding two side portions of said conditioning chamber with side shielding means which slidably contact said chill surface and minimize intrusion of ambient atmosphere into said conditioning chamber;

e. providing a selected, low density atmosphere within said conditioning chamber; and f. minimizing the intrusion of ambient atmosphere into a downstream side of said conditioning chamber with a resilient flap member.

2. An apparatus for casting metal strip, comprising:

a. nozzle means having an orifice for depositing a stream of molten metal onto a casting portion of a moving chill surface;

b. a conditioning shoe located at said casting portion for delimiting a conditioning chamber which borders at least three sidelines of said chill surface casting portion and which is in direct fluid communication with said nozzle orifice;

c. shielding means connected to said conditioning shoe for minimizing an intrusion of ambient atmosphere into said conditioning chamber and for deflecting an entrained gas boundary layer carried along by said chill surface, said shielding means being composed of a ceramic felt impregnated with graphite and comprising:

i. a front shield connected to said conditioning shoe and constructed to slidably contact said chill surface; and ii. at least two, spaced apart side shields connected to said conditioning shoe and to said front shield, said side shields extending downstream from said front shield and constructed to slidably contact said chill surface; and d. gas control means for providing a selected, low density atmosphere within said conditioning chamber.

3. An apparatus as recited in claim 2, wherein said side shields extend downstream from said front shield at least to a point beside the location of said nozzle orifice.

4. An apparatus as recited in claim 2, wherein said low density atmosphere is a selected level of partial vacuum.

5. An apparatus as recited in claim 2, further comprising a resilient, moveable flap member connected to an exit portion of said conditioning shoe to minimize intrusion of ambient atmosphere into the downstream side of said conditioning chamber.

6. An apparatus for casting metal strip, comprising:

a. reservoir means for holding molten metal and having a reservoir outlet adapted to pass molten metal therethrough;

b. nozzle means for depositing a stream of molten metal onto a casting portion of a moving chill surface, said nozzle means being separably connected to said reservoir means and having an orifice in communication with said reservoir outlet;

c. support means for selectively moving and holding said nozzle means operably connected to said reservoir means;

d. shielding means for deflecting an entrained gaseous boundary layer carried along by said chill surface and for minimizing an intrusion of ambient atmosphere onto said casting portion, said shielding means located about said chill surface casting portion and cooperating with said support means to delimit a localized conditioning chamber which communicates with said nozzle orifice;

e. gas control means in communication with said conditioning chamber for providing a low density atmosphere therein; and f. a resilient, moveable flap member connected to an exit portion of said conditioning chamber to minimize intrusion of ambient atmosphere into the downstream side of said conditioning chamber.

7. An apparatus as recited in claim 6, further comprising transfer means for selectively moving said support means to selectively connect and disconnect said nozzle means from said reservoir means.

8. An apparatus as recited in claim 6 further comprising a compressible gasket means located between said nozzle and said reservoir means, said gasket means allowing relative movement between said nozzle and reservoir means.

* * * * *